US008672692B2

(12) United States Patent
Chun et al.

(10) Patent No.: US 8,672,692 B2
(45) Date of Patent: Mar. 18, 2014

(54) USB CONNECTOR

(75) Inventors: In-Seong Chun, Seoul (KR); June Jang, Seoul (KR)

(73) Assignee: Pantech Co., Ltd., Seoul (KR)

( * ) Notice: Subject to any disclaimer, the term of this patent is extended or adjusted under 35 U.S.C. 154(b) by 95 days.

(21) Appl. No.: 13/367,835

(22) Filed: Feb. 7, 2012

(65) Prior Publication Data

US 2012/0282801 A1 Nov. 8, 2012

(30) Foreign Application Priority Data

May 3, 2011 (KR) ..... 10-2011-0042086

(51) Int. Cl.
*H01R 13/44* (2006.01)

(52) U.S. Cl.
USPC ..... 439/131; 439/31

(58) Field of Classification Search
USPC ..... 439/8, 13, 21, 31, 131, 660, 507.51, 439/607.58
See application file for complete search history.

(56) References Cited

U.S. PATENT DOCUMENTS

| | | | | |
|---|---|---|---|---|
| 7,179,099 | B2 * | 2/2007 | Hsieh | 439/131 |
| 7,824,186 | B2 * | 11/2010 | Zhao et al. | 439/13 |
| 7,828,599 | B2 * | 11/2010 | Zhao et al. | 439/607.34 |
| 8,075,318 | B2 * | 12/2011 | Zhao et al. | 439/13 |
| 8,206,163 | B2 * | 6/2012 | Zhao et al. | 439/131 |
| 2007/0066139 | A1 * | 3/2007 | Roeper et al. | 439/607 |

FOREIGN PATENT DOCUMENTS

| | | |
|---|---|---|
| KR | 10-2010-0085055 | 7/2010 |
| KR | 10-2011-0008606 | 1/2011 |

* cited by examiner

*Primary Examiner* — Thanh Tam Le
(74) *Attorney, Agent, or Firm* — H.C. Park & Associates, PLC

(57) ABSTRACT

A universal serial bus (USB) connector, includes an insertion unit insertable into a USB port; a terminal unit disposed on a portion of a first side of the insertion unit; a connection member to electrically connect the terminal unit and an internal circuit of a terminal body of the USB connector; a reinforcement unit disposed on a second side of the insertion unit to protect the insertion unit; and an insulating unit formed on an exposed surface of the reinforcement unit.

20 Claims, 9 Drawing Sheets

USB CONNECTOR

CROSS-REFERENCE TO RELATED APPLICATION

This application claims priority from and the benefit under 35 U.S.C. §119(a) of Korean Patent Application No. 10-2011-0042086, filed on May 3, 2011, which is incorporated by reference for all purposes as if fully set forth herein.

BACKGROUND

1. Field

The following description relates to a universal serial bus (USB) connector.

2. Discussion of the Background

Generally, universal serial bus (USB) refers to a bus standard that defines cables, connectors and protocols used for connection between peripheral devices and a personal computer. A USB type connector mounted on a variety of terminals, such as a personal computer, a digital camera, a mobile phone, an MP3 player, a portable multimedia player (PMP), a personal digital assistant (PDA), and the like, may be plugged into a USB receptacle of another device for data communication therebetween.

FIG. 1 is a perspective view illustrating a USB connector according to the related art.

As shown in FIG. 1, the USB connector includes a USB connector case 1, a substrate 2, an exterior shield 3, and a connection wire 4. The connection wire 4 is disposed inside the USB connector case 1. The substrate 2 has connectors which are disposed on, and may be fixed to, the substrate 2. One end of the connectors are connected to the connection wire 4 and the other end of the connectors are exposed to outside. The exterior shield 3 is made of metal and encloses the substrate 2. The connectors include four connectors including two power connectors and two data input/output connectors, which establish data communication if the USB connector is plugged into a USB receptacle of a peer device. The USB receptacle may refer to a USB socket, or a USB slot.

If the USB connector is installed in various types of terminals, a circuit unit disposed inside the USB connector is electrically connected to an internal circuit of the terminals having the USB connector. The USB connector may be received in a receiving hole formed on one side of a terminal, and may be exposed to the outside of the terminal, if necessary.

Various terminals, such as modems, MP3 devices, and the like, which deploy the USB connector, tend to be slimmer to improve portability. Thus, making the USB connector smaller may be one solution to design a slimmer terminal.

SUMMARY

Exemplary embodiments of the present invention provide a universal serial bus (USB) connector, including an insertion unit, a terminal unit and a reinforcement unit in replacement of a metal exterior shield.

Additional features of the invention will be set forth in the description which follows, and in part will be apparent from the description, or may be learned by practice of the invention.

Exemplary embodiments of the present invention provide a universal serial bus (USB) connector, including an insertion unit insertable into a USB port; a terminal unit disposed on a portion of a first side of the insertion unit; a connection member to electrically connect the terminal unit and an internal circuit of a terminal body of the USB connector; a reinforcement unit disposed on a second side of the insertion unit to protect the insertion unit; and an insulating unit formed on an exposed surface of the reinforcement unit.

Exemplary embodiments of the present invention provide a universal serial bus (USB) connector, including a terminal unit electrically connectable with a USB port; an insertion unit to be inserted into the USB port and to support a connection between the terminal unit and the USB port; a circuit unit to electrically connect with the terminal unit; a connection member to electrically connect the circuit unit and an internal circuit of a terminal body; a rotation unit to rotate the insertion unit and the terminal unit; a reinforcement unit to protect the insertion unit and the rotation unit; and an insulating unit to prevent electrical connection between the reinforcement unit and the USB port.

It is to be understood that both forgoing general descriptions and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
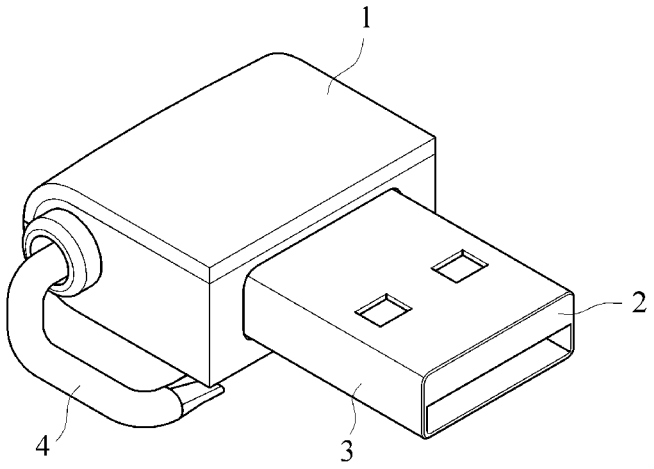
FIG. 1 RELATED ART
FIG. 1 is a perspective view illustrating a USB connector according to the related art.

Exemplary embodiments now will be described more fully hereinafter with reference to the accompanying drawings, in which exemplary embodiments are shown. The present disclosure may, however, be embodied in many different forms and should not be construed as limited to the exemplary embodiments set forth herein. Rather, these exemplary embodiments are provided so that the present disclosure is thorough, and will fully convey the scope of the invention to those skilled in the art. It will be understood that for the purposes of this disclosure, "at least one of each" will be interpreted to mean any combination the enumerated elements following the respective language, including combination of multiples of the enumerated elements. For example, "at least one of X, Y, and Z" will be construed to mean X only, Y only, Z only, or any combination of two or more items X, Y, and Z (e.g. XYZ, XZ, YZ, X). Throughout the drawings and the detailed description, unless otherwise described, the same drawing reference numerals are understood to refer to the same elements, features, and structures. The relative size and depiction of these elements may be exaggerated for clarity, illustration, and convenience.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 2:
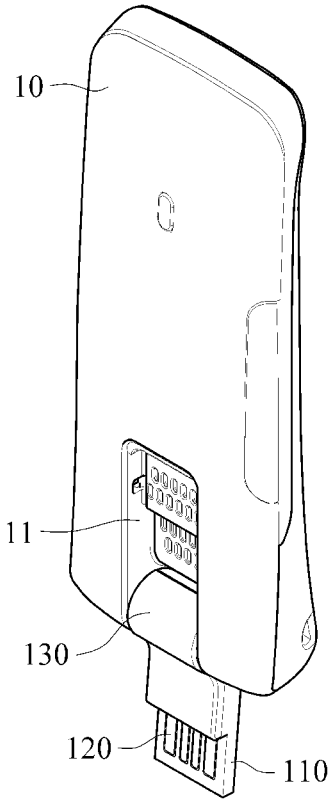
FIG. 2 is a perspective view illustrating a mobile terminal employing a universal serial bus (USB) connector according to an exemplary embodiment of the present invention.
Figure 3:
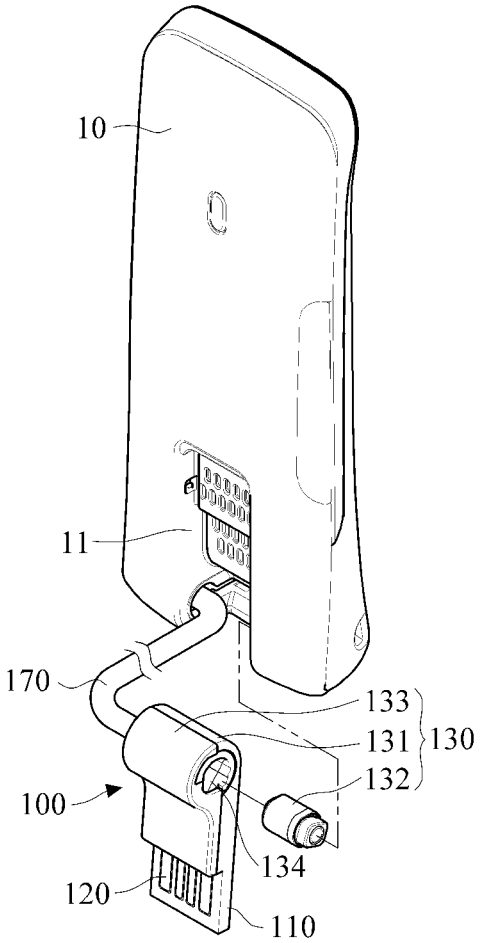
FIG. 3 is a partially exploded perspective view illustrating a mobile terminal and a USB connector according to an exemplary embodiment of the present invention.
Figure 4:
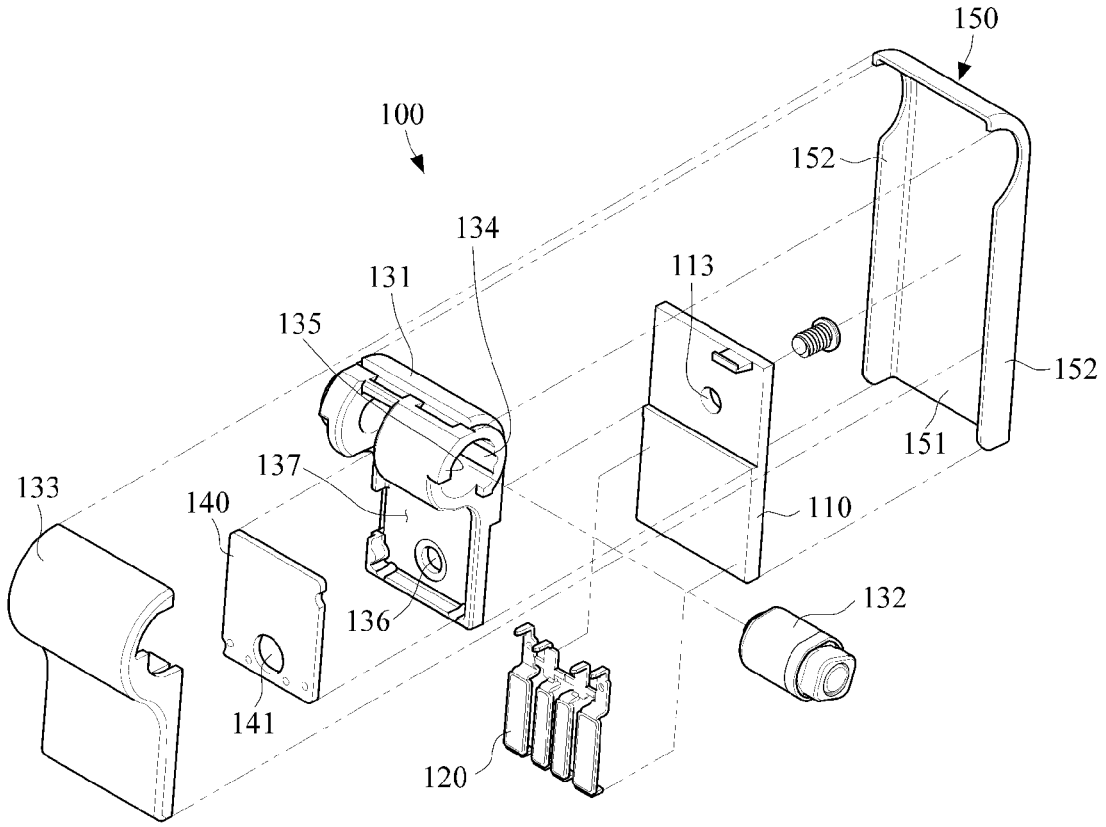
FIG. 4 is an exploded perspective view illustrating a USB connector according to an exemplary embodiment of the present invention.
Figure 5:
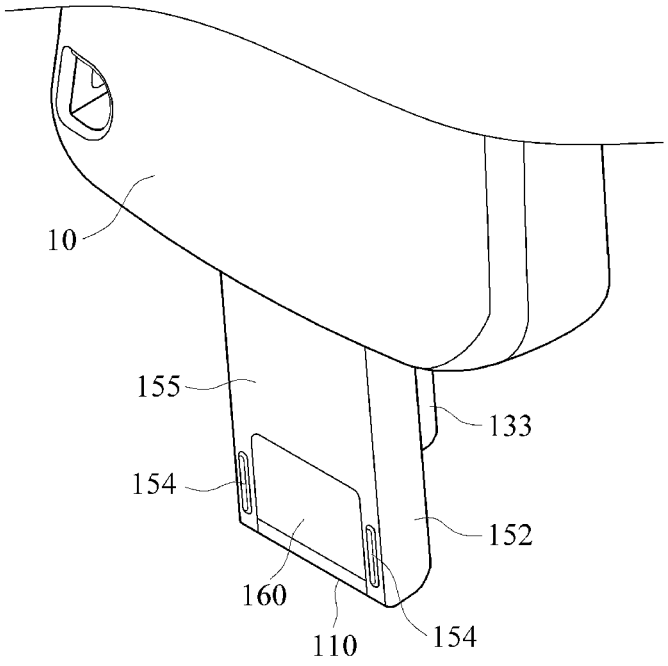
FIG. 5 is a rear view of a terminal having a USB connector according to an exemplary embodiment of the present invention.

FIG. 2 is a perspective view illustrating a mobile terminal employing a universal serial bus (USB) connector according to an exemplary embodiment of the present invention, and FIG. 3 is a partially exploded perspective view illustrating a mobile terminal and a USB connector according to an exemplary embodiment of the present invention. FIG. 4 is an exploded perspective view illustrating a USB connector according to an exemplary embodiment of the present invention, and FIG. 5 is a rear view of a terminal having a USB connector according to an exemplary embodiment of the present invention.

Figure 6:
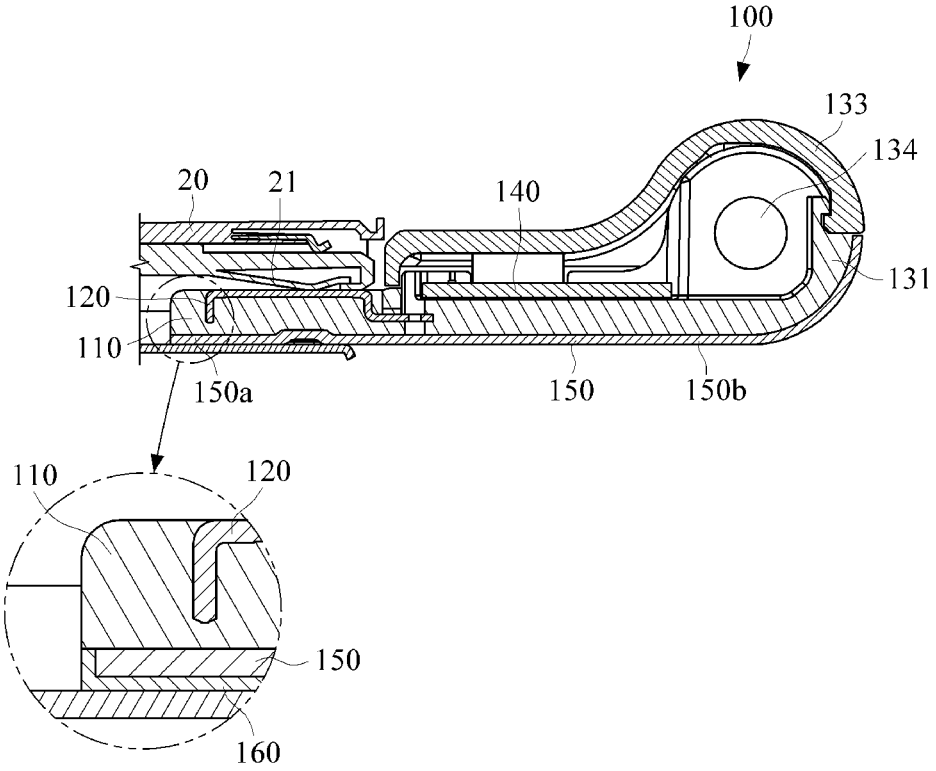
FIG. 6, FIG. 7, FIG. 8, and FIG. 9 are cross-sectional views illustrating a USB connector according to an exemplary embodiment of the present invention.

As shown in FIGS. 2 to 5, a USB connector 100 may be mounted on one end of a terminal and be connected to a USB port 20 of a peer device (see FIG. 6). The USB connector 100 and the terminal body 10 may be configured to be integrated into one body, or may be configured to be separated from each other. In the integrated configuration, the USB connector 100 may be accommodated in a receiving hole 11 of the terminal body 10 and be exposed to outside, if necessary. The USB connector 100 may be exposed to the outside by sliding the USB connector 100. Further, the USB connector 100 may be exposed to outside by rotating the USB connector 100 around a rotation unit 130 as shown in FIG. 2.

The USB connector 100 may include an insertion unit 110, a terminal unit 120, a connection member 170, a reinforcement unit 150, and an insulating unit 160. The insertion unit 110 may be inserted into the USB port 20 of the peer device. The terminal unit 120 may be disposed on a top side of the insertion unit 110 to be in contact with a terminal 21 of the USB port 20 for communication (see FIG. 6). The connection member 170 may electrically connect the terminal unit 120 and an internal circuit of the terminal body 10 for communication. The reinforcement unit 150 may be attached on a bottom side of the insertion unit 110 for enhancing durability of the insertion unit 110. The insulating unit 160 may be made of insulative material and may be formed on an exposed surface 155 of the reinforcement unit 150 to insulate the terminal 21 from the reinforcement unit 150.

The terminal body 10 may have a recessed groove, the receiving hole 11, to accommodate the USB connector 100 such that the terminal unit 120 faces the receiving hole 11. The USB connector 100 may remain in the receiving hole 11 while the USB connector 100 is not in use and the terminal unit 120 may face the receiving hole 11. If the USB connector 110 remains in the receiving hole 11, the bottom side of the insertion unit 110, a surface of the insertion unit 110 on which the terminal unit 120 is not formed, may be exposed to the outside of the terminal body 10 while the terminal unit 120 remains unexposed, and thus the terminal unit 120 may be protected from contamination or damage.

The insertion unit 110 may be configured to be inserted into the USB port 20, and may include a substrate to support the terminal unit 120. The terminal unit 120 may be mounted on a portion of the top side of the insertion unit 110. The area of the top side of the insertion unit 100 and the thickness of the insertion unit 110 may correspond to the size of a socket ("or a slot") of the USB port 20 into which the USB connector 100 may be inserted. That is, the size of the insertion unit 110 may be determined to be large enough to be inserted into the USB port 20 with a determined gap (e.g., about 0.1 to 1 mm) from the USB port 20 for connection stability.

The terminal unit 120 may be fixed to the top side of the insertion unit 110 to be in contact with the terminal 21 of the USB port 20 for communication, and may include a metal leg. The terminal unit 120 may be fixed at the insertion unit 100 and protrudes from the top side of the insertion unit 110 with a determined height to facilitate the contact with the terminal 21 disposed in the USB port 20.

In addition, to improve the lifetime of the USB connector 100, the terminal unit 120 may have a surface plated with gold or silver to be protected from oxidation due to air contamination and from corrosion due to contacts with the hand of a user. In order to be integrated with the insertion unit 110, the terminal unit 120 may be fixed at the top side of the insertion unit 110 by a variety of molding methods, or may be formed on the surface of the top side of the insertion unit 110 by an anti-corrosion method such as copper exposure.

The connection member 170 may have one end connected to the terminal unit 120 and the other end connected to the internal circuit of the terminal body 10, thereby enabling a communication between the terminal unit 120 and the internal circuit of the terminal body 10. The connection member 170 may be a conductor, such as a wire that allows electric currents to flow, and may transfer an electrical signal input from the terminal unit 120 to the internal circuit of the terminal body 10, or in reverse, transfer an electrical signal from the internal circuit of the terminal body 10 to the terminal unit 120 to output data to an external device.

The reinforcement unit 150, which is configured to be fixed on the bottom side of the insertion unit 110 for enhancing the durability of the USB connector, may be made of a durable material, such as a metal material. The reinforcement unit 150 may be made in a form of a metal sheet to improve the durability of the insertion unit 110 and to protect the insertion unit 110. Further, the reinforcement unit 150 may be made of stainless steel to increase corrosion resistance, thereby improving the lifetime of the USB connector 100.

Moreover, because the reinforcement unit 150 covers the bottom side of the insertion unit 110, if the USB connector 100 remains in the receiving hole 11 formed on the terminal body 10, the reinforcement unit 150 may be exposed to the outside while the other parts are not exposed to the outside. Further, the reinforcement unit 150 may be designed to be matched with the material and color of the terminal body 10 to which the USB connector 100 is mounted without matching the material and the color of the insertion unit 110 with the terminal body 10. Further, the reinforcement unit 150 may be attached to the insertion unit 110 by a variety of methods, such as ultrasonic welding, bonding, and the like, to improve the contact and adhesion between the reinforcement unit 150 and the insertion unit 110.

The insulating unit 160 may be made of an insulative material and be formed on an exposed surface 155 of the reinforcement unit 150 for insulation of the reinforcement unit 150. The exposed surface 155 may refer to all surfaces of the reinforcement unit 150 that are exposed to outside, and may be a remaining area that is not in contact with the insertion unit 110.

If the reinforcement unit 150 is made of a metal material and the reinforcement unit 150 contacts with the terminal 21 of the USB port 20, an electrical impulse may occur, thereby causing device damage or data loss. Specifically, if the USB connector 100 is inserted in the opposite direction, such that the reinforcement unit 150 on the opposite side of the terminal unit 120 contacts with the terminal 21, the insulating unit 160 may prevent the electrical connection between the terminal 21 of the USB port 20 and the reinforcement unit 150 made of a metal material.

Moreover, the insulating unit 160 may be formed on the entire exposed surface of the reinforcement unit 150, or on a specific portion of the exposed surface that is more likely to be in contact with the terminal 21 of the USB port 20 than any other portion. The insulating unit 160 may be formed on a leading end 150*a* of the exposed surface 155 of the reinforcement unit 150 as shown in FIG. 5 and FIG. 6. In other words, the insulating unit 160 may not be necessarily formed on both side edges 152 and/or a rear side 150*b* of the reinforcement unit 150 that are not likely to be in contact with the terminal 21 of the USB port 20 if the USB connector 100 is inserted in the opposite direction.

The insulating unit 160 may be made of any insulative material, and may be formed on the exposed surface 155 of the reinforcement unit 150, which is the opposite surface of the inner surface 151, by a variety of methods, such as coating spraying, dipping, and bonding.

Further, the USB connector 100 may include a rotation unit 130 that extends from a rear side of the insertion unit 110 and is rotatably installed in the terminal body 10. The rear side of the insertion unit 110 may be a portion of the insertion unit 110, which is not inserted into the USB port 20, i.e., opposite the terminal unit 120. The rotation unit 130 may be applied to rotate the USB connector 100 to be accommodated into the receiving hole 11 or to be exposed from the receiving hole 11 of the terminal body 10 to be connected to a peer device. If the USB connector 100 is inserted into a peer device, the rotation unit 130 may rotate the terminal body 10 with respect to the peer device or may rotate the peer device with respect to the terminal body 10.

The rotation unit 130 may be integrally configured with the insertion unit 110, or separately configured from the insertion unit 110. The separated configuration may be used in molding the insertion unit 110 and the rotation unit 130 to produce each of the insertion unit 110 and the rotation unit 130 having a different characteristic. Further, it may be more difficult to make the insertion unit 110 and the rotation unit 130 with the same material because the insertion unit 110 having the terminal unit 120 may need to have an aesthetically designed exterior and the rotation unit 130 may need to have advanced strength and durability since the rotation unit 130 is fixed and rotates with respect to the terminal body 10 via a hinge 132.

Thus, the separated configuration may be more appropriate for the formation of the insertion unit 110 and the rotation unit 130 or the production of molds for the insertion unit 110 and the rotation unit 130. Moreover, the insertion unit 110 and the rotation unit 130 may be made of different materials, thus an exterior design of the product can be changed and an internal strength and durability can be enhanced by changing the material of the insertion unit 110 or the rotation unit 130.

Further, the USB connector 100 may include a circuit unit 140, which is electrically connected to the terminal unit 120 and the connection member 170, and communicates with the internal circuit of the terminal body 10. The circuit unit 140 may have one end connected to the terminal unit 120 and the other end connected to the connection member 170, thereby enabling data communication between an internal circuit of a peer device and the internal circuit of the terminal having the USB connector 100. The circuit unit 140 may be a printed circuit board that is applied to a USB interface. Further, the circuit unit 140 may be disposed behind the terminal unit 120 and may be disposed inside the rotation unit 130.

Further, the rotation unit 130 may include a rotation frame 131, the hinge 132, and a cover 133. The rotation frame 131 may be connected to one end of the insertion unit 110 and may have a space 137 therein. The hinge 132 rotatably connects the rotation frame 131 to the terminal body 10. The cover 133 may be mounted on an upper portion of the rotation frame 131 to enclose the space 137.

The rotation frame 131 may be connected to the terminal body 10 via the hinge 132. Hence, each of the rotation frame 131 and the terminal body 10 has a hinge receiving groove 134 to accommodate each side of the hinge 132, respectively. The outer edge of the hinge receiving groove 134 formed on the rotation frame 131 or the terminal body 10 may have a stopper 135 to regulate a rotation angle of the hinge 132. For example, the stopper 135 may stop the hinge 132 each time the USB connector 100 is rotated by 45 or 90 degrees. Moreover, the rotation frame 131 may have an upper portion with the space 137 recessed therein, and the circuit unit 140 may be disposed in the space 137. The cover 133 may be combined on the upper portion of the rotation frame 131 to enclose the space 137 for protecting the circuit unit 140 to not be exposed to outside.

The insertion unit 110 and the rotation frame 131 may be detachably fixed to each other. For example, the insertion unit 110 and rotation frame 131 may be overlapped at their one ends, and fixation holes 113 and 136 may be formed on the respective corresponding portions of the insertion unit 110 and the rotation frame 131, and a fastener such as a screw may be inserted into the fixation holes 113 and 136, thereby fixing the insertion unit 110 and the rotation frame 131 to each other.

Furthermore, if the circuit unit 140 is disposed in the space 137, a fixation hole 141 may be formed on the circuit unit 140 at a position corresponding to the fixation holes 113 and 136, thereby fixing the circuit unit 140 to the insertion unit 110 and the rotation frame 131. The screw may be fixed at the inside surface of the cover 133. The rotation frame 131 and the insertion unit 110 may rotate simultaneously while the rotation frame 131 is connected to the insertion unit 110.

The rotation unit 130 may rotate around the hinge 132, a rotation axis. As the rotation unit 130 rotates, the insertion unit 110 that extends from one end of the rotation unit 130 and the terminal unit 120 fixed on one surface of the insertion unit 110 rotates and the terminal unit 120 accommodated inside the receiving unit 11 may be exposed to outside. The exposed terminal unit 120 may be inserted into the USB port 20 of the peer device, such as a PC, for connection.

Further, the reinforcement unit 150 may be attached on a bottom side of the rotation unit 130 as well as on the insertion unit 110. Hence, a durability of the rotation unit 130 may be enhanced, and the insertion unit 110 and the rotation unit 130 may be integrated with each other.

As shown in FIG. 4, the reinforcement unit 150 may include an inner surface 151 that is attached onto the bottom side of the insertion unit 110, and side walls 152 perpendicularly extended from both sides of the inner surface 151 and are attached to both sides of the insertion unit 110.

If the shape of the reinforcement unit 150 is 'U' having the inner surface 151 and the side walls 152, the reinforcement unit 150 supports more area including the bottom side and the side walls of the insertion unit 110 by covering the bottom side and the side walls of the insertion unit 110 with the inner surface 151 and the side walls 152. Thus, the durability of the insertion unit 110 and adhesion between the insertion unit 110 and the reinforcement unit 150 may be enhanced since the insertion unit 110 is partially enclosed by the reinforcement unit 150.

The height of each of the side walls 152 may be determined as high as the thickness of the insertion unit 110 so as to enclose the both sides of the insertion unit 110 and to abut the top side of the insertion unit 110, or the side walls 152 may protrude from the top side of the insertion unit 110 with a determined height. The protruding side walls 152 may prevent the USB connector 100 from being reversely inserted.

Referring to FIG. 5, the reinforcement unit 150 may further include projection units 154 protruding outwards from the exposed surface 155. The projection units 154 may be formed on both sides of a leading end 150*a* of the bottom side of the reinforcement unit 150 as shown in FIG. 5. The projection units 154 may serve as grounds in contact with a bottom surface inside the USB port 20 if the USB connector 100 is inserted into the USB port 20 of the peer device. Further, the projection units 154 may improve radio frequency (RF) performance and provide circuit protection from electrostatic charge. Further, the projection units 154 may guide the insertion of the insertion unit 110.

FIG. 6, FIG. 7, FIG. 8, and FIG. 9 are cross-sectional views illustrating a USB connector according to an exemplary embodiment of the present invention.

Referring to FIG. 6, the insulating unit 160 may include a bent portion to prevent a connection between the reinforcement unit 150 and the USB port 20.

Figure 7:
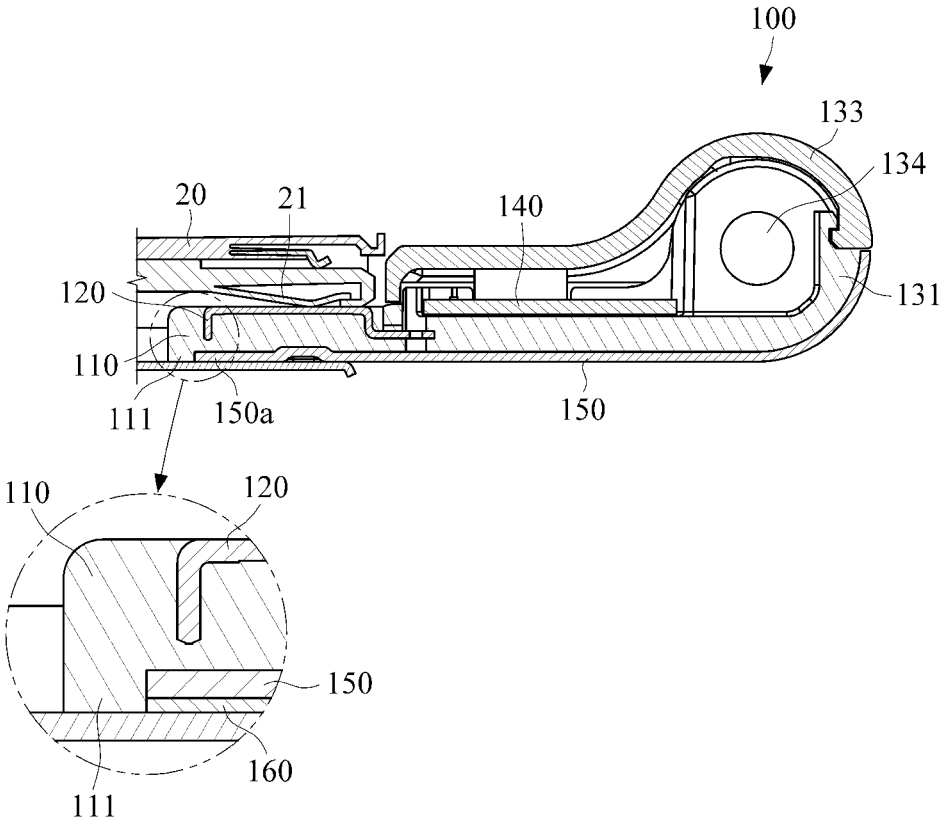

Referring to FIG. 7, the insertion unit 110 may further include a bent portion 111 that extends to the direction perpendicular to and toward the bottom surface of the insertion unit 110 to enclose the leading end 150*a* of the reinforcement unit 150, and accordingly the insertion unit 110 may have an 'L'-shaped cross-section as shown in FIG. 7.

If the insertion unit 110 has the 'L'-shaped cross-section, the leading end 150*a* of the reinforcement unit 150 may be protected by the bent portion 111, thereby preventing from being scratched or cracked. In addition, if the USB connector 100 is inserted into the USB port 20, the reinforcement unit 150 is prevented from being in contact with the terminal 21 of the USB port 20. Thus, the damage that may occur due to an electrical impulse, which may occur when the metallic reinforcement unit 150 comes in contact with the terminal 21, may be prevented.

Figure 8:
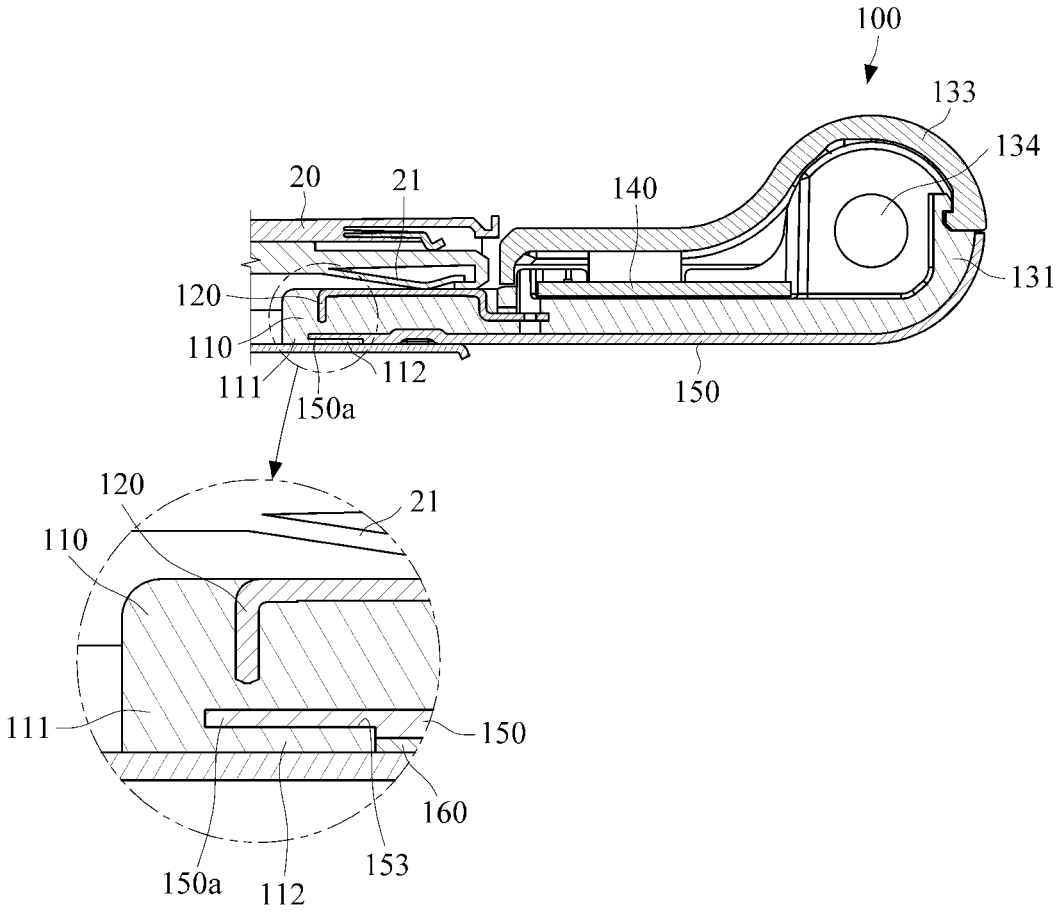

Referring to FIG. 8, the insertion unit 110 may have a 'U'-shaped cross-section, including a bent portion 111 that extends vertically from the insertion unit 110 to enclose the leading end 150*a* of the reinforcement unit 150 and a horizontal portion 112 that extends backward from the inner side of the bent portion 111 to enclose the bottom surface of the reinforcement unit 150. The horizontal portion 112 may extend from the inner side of the bent portion 111 to the direction parallel to the bottom surface of the insertion unit 110.

If the insertion unit 110 having the 'U'-shaped cross-section, the leading end 150*a* of the reinforcement unit 150 may be protected by the bent portion 110 and the horizontal portion 112, and thus the reinforcement unit 150 and the terminal 21 of the USB port 20 may be prevented from being in contact with each other when the USB connector 100 is inserted into the USB port 20. Thus, the damage that may occur due to the electrical impulse may be prevented, and the reinforcement unit 150 may be more securely fixed to the insertion unit 110. Further, the insertion unit 110 may be made of an insulative material, and the insertion unit 110 may insulate the reinforcement unit 150.

Further, the insulating unit 160 is an insulating layer formed by coating the exposed surface 155 of the reinforcement unit 150 with an insulative material.

The insulative material may be any insulative material including prepreg that is made by impregnating glass cloth with an insulative material, such as epoxy resin, resin coated copper foil, high-density silica having superior processability and thermal endurance, and the combination of organic polymers for enhancing strength and improving insulation properties.

To coat the exposed surface 155 of the reinforcement unit 150 with the insulative material, a variety of methods may be used to form the insulating unit 160 as a coating thin film. The coating thin film may be generated by coating the exposed surface 155 of the reinforcement unit 150 with liquid insulative substance using spraying coating, dipping coating, spin coating, or the like, gelling the thin film to obtain silica film, and drying the silica film to acquire silica xerogel thin film as the coating thin film.

Further, the insulating unit 160 may be an insulating sheet attached to the exposed surface 155 of the reinforcement unit 150. The reinforcement sheet may be made of an insulative material, such as an insulating plate, an insulating tape, and the like, and may be attached to the exposed surface 155 of the reinforcement unit 150 by an adhesion method.

Further, the insulating unit 160 may be an adhesive film that is generated by forming a thermosetting resin layer on an exfoliative plastic film. The insulating unit 160 may be formed by laminating the adhesive film on the exposed surface 155 of the reinforcement unit 150, exfoliating the plastic film, and thermosetting the thermosetting resin. Meanwhile, the insulating unit 160 may be made of prepreg.

Figure 9:
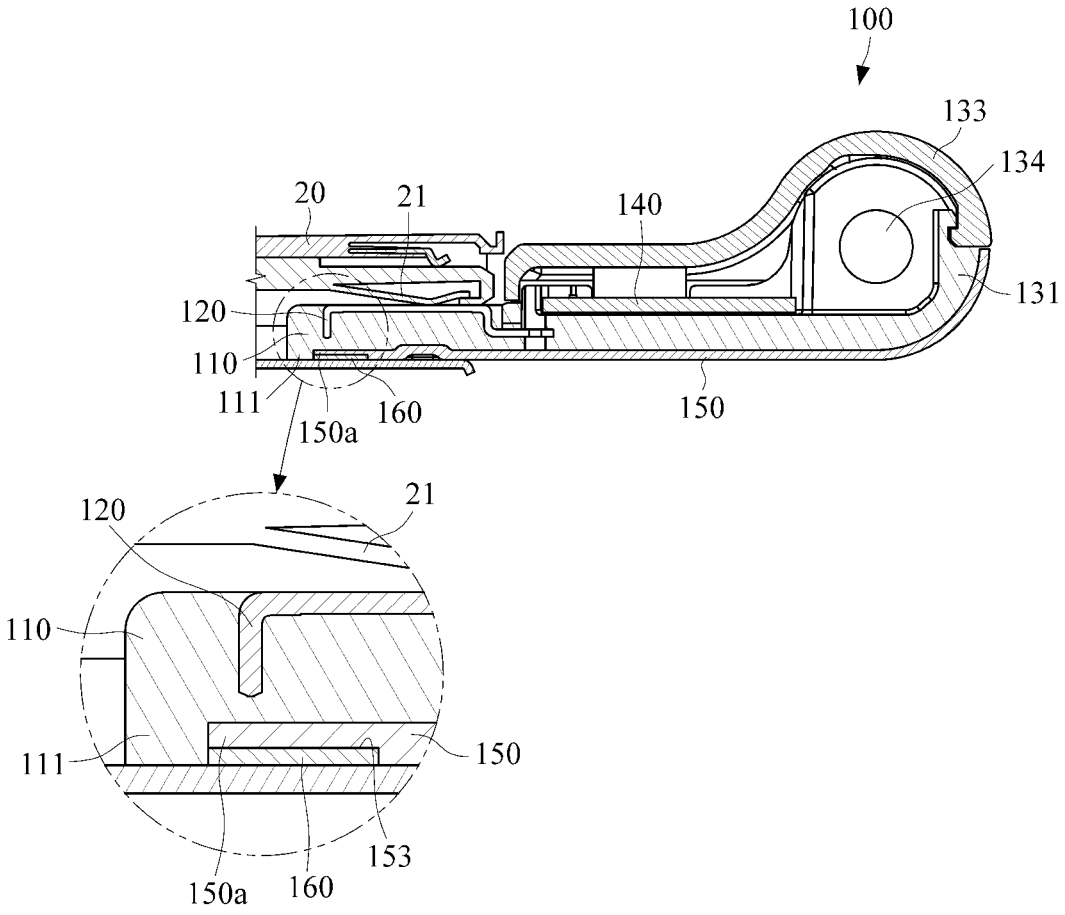

Referring to FIG. 9, the reinforcement unit 150 may have a receiving groove 153 having the thickness identical to or similar to the horizontal portion 112 or the insulating unit 160 at the leading end 150*a* such that the horizontal portion 112 or the insulating unit 160 can be smoothly inserted into the receiving groove 153.

If the horizontal portion 112 extended from the insertion unit 110 or the sheet-shaped insulating unit 160 is positioned on the bottom surface of the leading end 150*a* of the reinforcement unit 150, the horizontal portion 112 or the insulating unit 160 may protrude in comparison with the bottom surface of the reinforcement unit 150 and may not be seamlessly connected with the reinforcement unit 150, thereby preventing smooth insertion into the USB port 20 and resulting in less convenience to use. Thus, the horizontal portion 112 or the insulating unit 160 may be seamlessly connected with the reinforcement unit 150 to form a smooth surface therebetween. Hence, the receiving groove 153, which is recessed by the thickness of the horizontal portion 112 or the insulating unit 160, may be formed on the bottom surface of the leading end 150*a*, and the receiving groove 153 accommodates the horizontal portion 112 or the insulating unit 160 such that the surfaces of the horizontal portion 112 or the insulating unit 150 and the insulating unit 160 coincide with each other without having a protruded portion as shown in FIG. 9.

Aspects of the present invention may provide a USB connector 10 that may include the thin-plated insertion unit 110 on which the terminal unit 120 is disposed without having an exterior shield, thereby reducing overall thickness of the USB connector 10 and enabling a smaller terminal that has the USB connector 10. Furthermore, durability of the thin-plated insertion unit 110 may be enhanced by the reinforcement unit 150. Further, if the reinforcement unit 150 is made of metal, the insulating unit 160 may be formed on the exposed surface 155 of the reinforcement unit 150 for insulation purpose, thereby preventing device damage occurring from an electrical impulse if the USB connector 10 is inserted the other way around.

Aspects of the present invention may provide a USB connector having a slimmer volume by eliminating the exterior shield 3 of the conventional USB connector, thereby providing a slimmer device on which the USB connector is mounted.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A universal serial bus (USB) connector, comprising:

an insertion unit insertable into a USB port;

a terminal unit disposed on a portion of a first side of the insertion unit, the terminal unit being electrically connectable with a terminal of the USB port when the insertion unit is inserted into the USB port in a first direction;

a connection member to electrically connect the terminal unit and an internal circuit of a terminal body of the USB connector;

a reinforcement unit disposed on a second side of the insertion unit to protect the insertion unit; and an insulating unit formed on an exposed surface of the reinforcement unit, the insulating unit comprising an insulating material to contact the terminal of the USB port when the insertion unit is inserted into the USB port in a second direction.

2. The USB connector of claim 1, further comprising:

a rotation unit to rotatably extend a first end of the insertion unit with respect to the terminal body.

3. The USB connector of claim 2, wherein the rotation unit further comprises:

a rotation frame to rotate the insertion unit with respect to the terminal body;

a hinge to rotatably connect the rotation frame to the terminal body; and a cover combined with the rotation frame to cover the space of the rotation frame, wherein the rotation frame has a space to accommodate a circuit unit.

4. The USB connector of claim 2, wherein the reinforcement unit encloses a portion of the insertion unit and the rotation unit.

5. The USB connector of claim 1, further comprising:

a circuit unit electrically connected between the terminal unit and the connection member to communicate with the internal circuit of the terminal body.

6. The USB connector of claim 1, wherein the reinforcement unit further comprises:

an inner surface attached to the second side of the insertion unit; and side walls to cover two sides of the insertion unit.

7. The USB connector of claim 1, wherein the reinforcement unit further comprises a projection unit protruding from the exposed surface of the reinforcement unit to prevent an electrical connection between and the reinforcement unit and the USB port.

8. The USB connector of claim 1, wherein the insertion unit further comprises a bent portion extending in a direction perpendicular to the first side of the insertion unit to enclose one end of the reinforcement unit and a horizontal portion extending from the bent portion in a direction parallel to the first side of the insertion unit to enclose a portion of the exposed surface of the reinforcement unit.

9. The USB connector of claim 8, wherein the reinforcement unit further comprises a receiving groove recessed at the one end of the reinforcement unit such that the horizontal portion or the insulating unit is inserted in the receiving groove without having a protrusion.

10. The USB connector of claim 1, wherein the insulating unit comprises an insulating layer disposed on the exposed surface of the reinforcement unit.

11. The USB connector of claim 1, wherein the insulating unit comprises an insulating sheet disposed on the exposed surface of the reinforcement unit.

12. The USB connector of claim 11, wherein the reinforcement unit further comprises a receiving groove recessed from the one end of the reinforcement unit such that the horizontal portion or the insulating unit is inserted in the receiving groove without having a protrusion.

13. The USB connector of claim 1, wherein the insulating unit comprises a bent portion extending in a direction perpendicular to the first side of the insertion unit to enclose one end of the reinforcement unit.

14. A universal serial bus (USB) connector, comprising:

an insertion unit insertable into a USB port;

a terminal unit disposed on a portion of a first side of the insertion unit;

a connection member to electrically connect the terminal unit and an internal circuit of a terminal body of the USB connector;

a reinforcement unit disposed on a second side of the insertion unit to protect the insertion unit; and an insulating unit formed on an exposed surface of the reinforcement unit, wherein the insertion unit further comprises a bent portion extending in a direction perpendicular to the first side of the insertion unit to enclose one end of the reinforcement unit.

15. A universal serial bus (USB) connector, comprising:

a terminal unit electrically connectable with a terminal of a USB port when a first side of the USB connector faces the terminal of the USB port;

an insertion unit to be inserted into the USB port and to support a connection between the terminal unit and the terminal of the USB port;

a circuit unit to electrically connect with the terminal unit;

a connection member to electrically connect the circuit unit and an internal circuit of a terminal body;

a rotation unit to rotate the insertion unit and the terminal unit;

a reinforcement unit to protect the insertion unit and the rotation unit; and an insulating unit to prevent electrical connection between the reinforcement unit and the USB port, the insulating unit comprising an insulating material to contact the terminal of the USB port when a second side of the USB connector faces the terminal of the USB port.

16. The USB connector of claim 15, wherein the insertion unit comprises a bent portion to prevent a connection between the reinforcement unit and the USB port, and a horizontal portion to enclose a portion of the reinforcement unit.

17. The USB connector of claim 15, wherein the reinforcement unit further comprises a receiving groove recessed from the one end of the reinforcement unit such that the horizontal portion or the insulating unit is inserted in the receiving groove without having a protrusion.

18. The USB connector of claim 15, wherein the reinforcement unit further comprises a projection unit, protruded from the exposed surface of the reinforcement unit, to prevent an electrical connection between the reinforcement unit and the USB port and to guide an insertion of the insertion unit.

19. The USB connector of claim 15, wherein the rotation unit comprises a rotation frame, a hinge, and a cover, wherein the rotation frame comprises a space to accommodate the circuit unit, the hinge stops a rotation of the rotation unit at a determined angle, and the cover encloses the space with the rotation frame.

20. The USB connector of claim 19, wherein the insertion unit comprises a first hole, the rotation frame comprises a second hole, the circuit unit comprise a third hole, and the insertion unit, the rotation unit, the circuit unit and the cover are fixed by a fastener through the first hole, the second hole and the third hole.

* * * * *